United States Patent [19]

Bakkila et al.

[11] Patent Number: 4,686,976

[45] Date of Patent: Aug. 18, 1987

[54] SAFETY MASK

[76] Inventors: Charles A. Bakkila, 7839 Salem Rd., Northville, Mich. 48167; Frederick P. Warrick, 18207 132nd Ave., Sun City West, Ariz. 85375

[21] Appl. No.: 815,120

[22] Filed: Dec. 27, 1985

Related U.S. Application Data

[63] Continuation of Ser. No. 675,879, Nov. 28, 1984, abandoned.

[51] Int. Cl.[4] ..... A62B 7/10

[52] U.S. Cl. ..... 128/206.15; 128/206.17

[58] Field of Search ..... 128/201.13, 201.22, 128/201.23, 201.24, 201.25, 201.28, 205.12, 205.24, 205.25, 205.27–205.29, 206.14–206.17, 206.27; 251/121, 122; 138/45; 55/502, 503, 505, 378, 496, DIG. 33, DIG. 35; 220/257, 215, 319

[56] References Cited

U.S. PATENT DOCUMENTS

| | | | |
|---|---|---|---|
| 1,262,566 | 4/1918 | Rhodes et al. | 128/201.25 |
| 1,464,883 | 8/1923 | Phillips et al. | 128/201.15 |
| 1,845,460 | 2/1932 | Watters | 128/205.12 |
| 2,410,593 | 11/1946 | Wright | 128/200.27 |
| 2,438,058 | 3/1948 | Kincheloe | 128/205.12 |
| 3,467,965 | 9/1969 | Murphy | 128/201.25 |
| 3,850,341 | 11/1974 | Bart | 215/319 |
| 4,131,441 | 12/1978 | Randall | 55/505 |
| 4,179,274 | 12/1979 | Moon | 128/206.17 |
| 4,320,755 | 3/1982 | Flint et al. | 128/205.12 |
| 4,483,544 | 6/1984 | Silverthorn | 128/206.17 |

FOREIGN PATENT DOCUMENTS

| | | | |
|---|---|---|---|
| 23059 | 10/1930 | Australia | 128/202.13 |
| 535789 | 2/1955 | Belgium | 128/202.13 |
| 458039 | 7/1949 | Canada | 128/200.27 |
| 466452 | 7/1950 | Canada | 128/202.13 |
| 2121130 | 10/1972 | Fed. Rep. of Germany | 128/206.15 |
| 829633 | 4/1938 | France | 128/206.17 |
| 882233 | 2/1943 | France | 128/205.25 |
| 102415 | 8/1963 | Norway | 128/206.17 |
| 1561773 | 3/1980 | United Kingdom | 128/206.17 |
| 227852 | 2/1969 | U.S.S.R. | 128/200.27 |

*Primary Examiner*—Henry J. Recla
*Assistant Examiner*—Karin M. Reichle
*Attorney, Agent, or Firm*—Barnes, Kisselle, Raisch, Choate, Whittemore & Hulbert

[57] ABSTRACT

For use in a safety mask comprising a body adapted to be placed over the nose and mouth wherein the body has an inlet valve, a filter associated with the inlet valve and an outlet valve, the arrangement comprising a cap adapted to be positioned over the filter, and having an opening in a wall thereof, a tube connected to the opening, and to a valve adapted to be attached to the body of the wearer. The valve includes an inlet for connection to a source of clean air, a first outlet to the tube connected to the opening in the mask and a second outlet for attachment to a paint spray gun.

4 Claims, 10 Drawing Figures

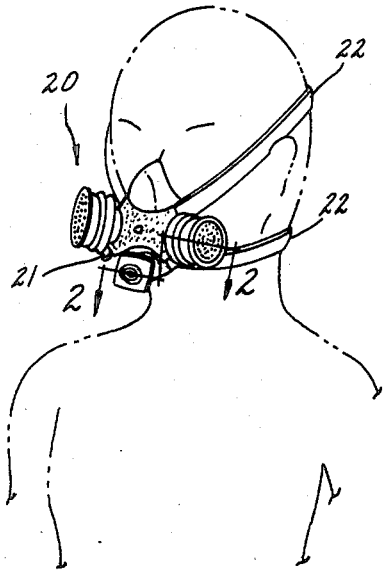
FIG. 1
PRIOR ART
FIG. 2
PRIOR ART
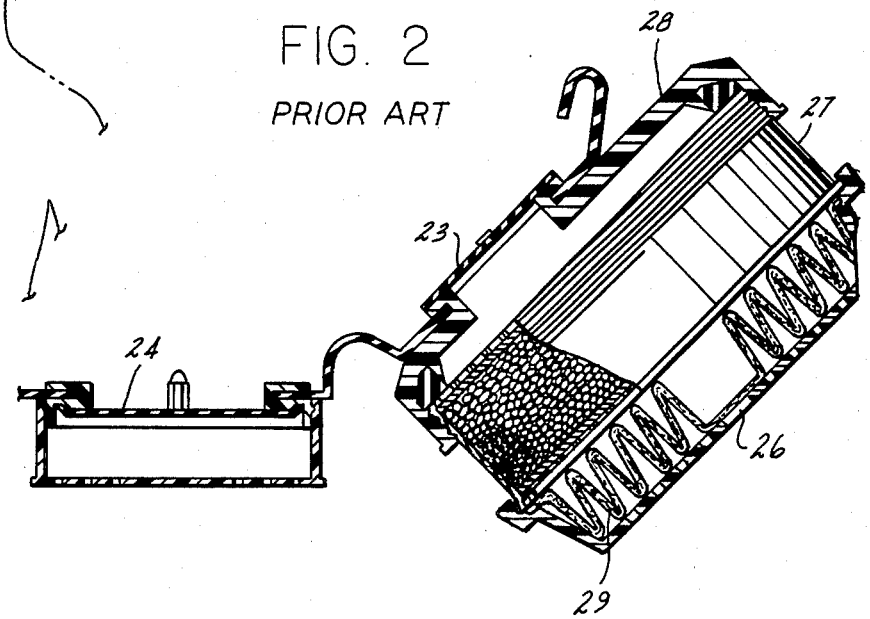
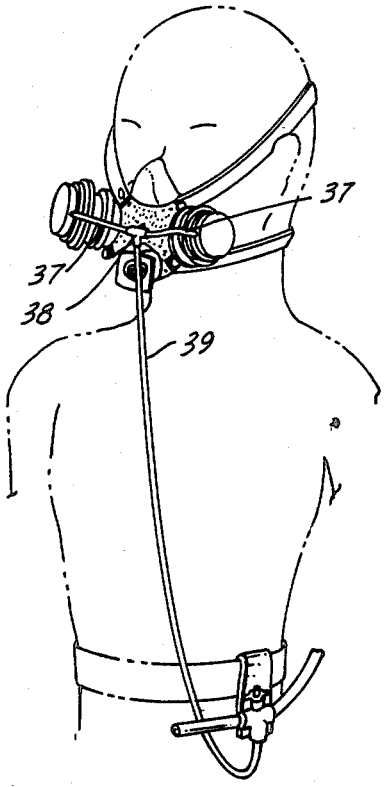
FIG. 3
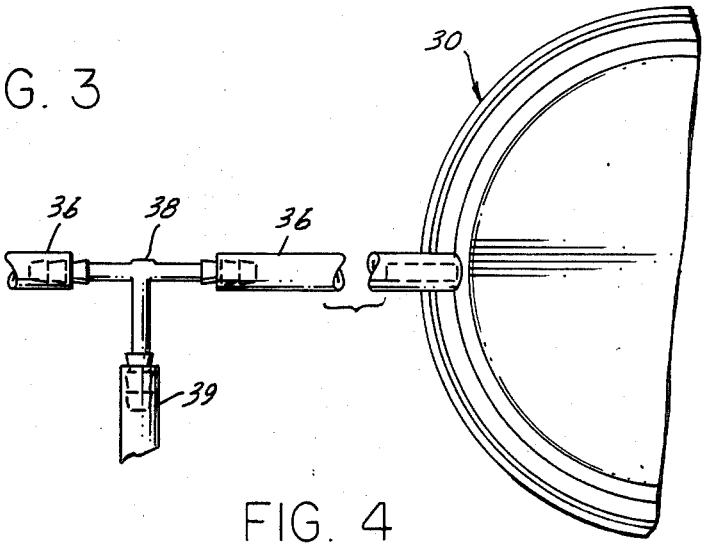
FIG. 4

SAFETY MASK

This application is a continuation of application Ser. No. 675,879, filed Nov. 28, 1984, now abandoned.

This invention relates to safety masks and particularly safety masks of the type that are commonly used in connection with spray painting.

BACKGROUND AND SUMMARY OF THE INVENTION

In spray painting and the like, it is conventional to provide a mask that comprises a body adapted to fit over the mouth and nose of the wearer and be held in position by straps. Such an arrangement includes one or more inlet valves and associated filters through which the wearer inhales and an outlet valve through which the wearer exhales.

Where the environment is very contaminated, it is common that there be provided a pair of filters in series at the inlet valves, a cotton or cellulose filter to filter out particles and an activated charcoal filter to filter out solvent vapors. Such filters need to be replaced frequently. As a result, the use of such masks is expensive.

Another problem with standard type mask arrangements is that they are unsatisfactory for the wearer who has heavy facial hair because of the inability of the mask to seal around the face or for persons having differently shaped faces.

Among the objectives of the present invention are to provide an arrangement for conversion of the conventional safety masks for connection to a source of clean air; which can be readily adapted to conventional safety masks; which is low in cost; which obviates the need for a particle filter; which can be adapted to various types of safety masks; and which can be used in an environment of highly toxic paints.

In accordance with the invention, a cap is adapted to be positioned over the conventional filter and is interconnected to the filter. The cap has an opening in a wall thereof, and is connected by a tube to a valve supported by the body of the wearer. The valve includes an inlet for connection to a source of clean air, a first outlet to the tube connected to the opening in the mask and a second outlet for connection to a paint spray gun.

DESCRIPTION OF THE DRAWINGS

FIG. 1 is a perspective view of a prior art safety mask.

FIG. 2 is a sectional view taken along the line 2—2 in FIG. 1.

FIG. 3 is a partly diagrammatic perspective view showing a safety mask embodying the invention.

FIG. 4 is a fragmentary plan view of a portion of the attachment utilized in the safety mask.

DESCRIPTION

Figure 5:
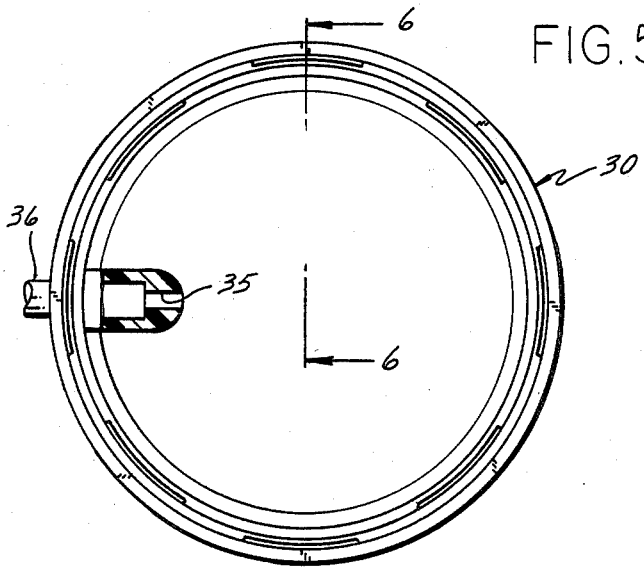
FIG. 5 is a part sectional bottom plan view of a portion of the attachment.

Referring to FIGS. 1 and 2, the invention is adapted for use with a conventional safety mask 20 comprising a flexible body 21 adapted to fit over the mouth and nose of the wearer and held in position by straps 22. The mask includes an outlet valve 24 and a pair of inlet valves 23 which are normally covered by removable covers 26 having openings therein. In such a conventional and well known mask, a vapor solvent filter 27 is threaded into each receptacle 28 overlying the inlet valve 23. A particulate contaminant filter 29 is positioned on the filter 27 and then the perforated cover 26 is snapped in position over the vapor filter 25 thus holding the particulate filter 29 in place.

Figure 6:
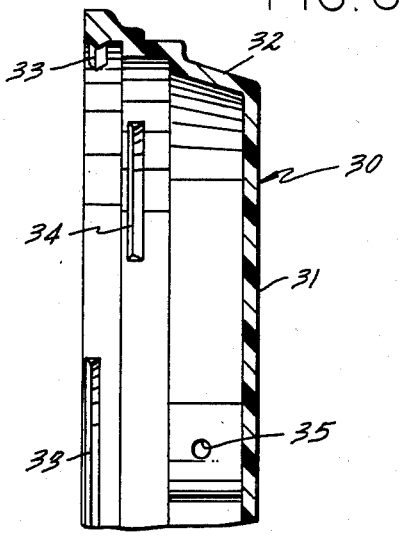
FIG. 6 is a fragmentary sectional view taken along the line 6—6 in FIG. 5.
Figure 7:
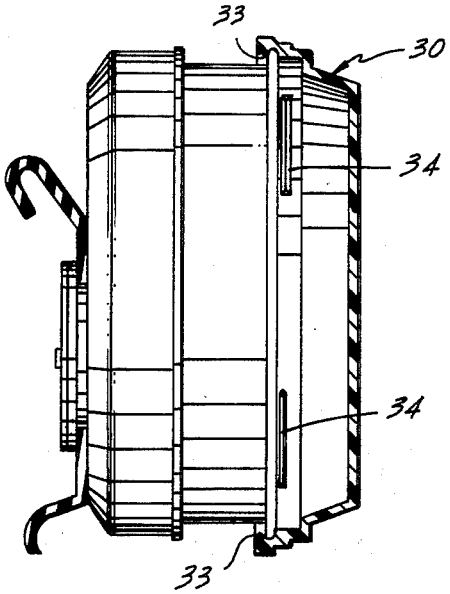
FIG. 7 is a fragmentary sectional view of the portion shown in FIG. 6 as attached to a filter.
Figure 8:
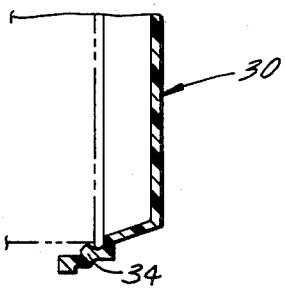
FIG. 8 is a fragmentary sectional view of the portion shown in FIG. 6 as attached to a different size filter.
Figure 10:
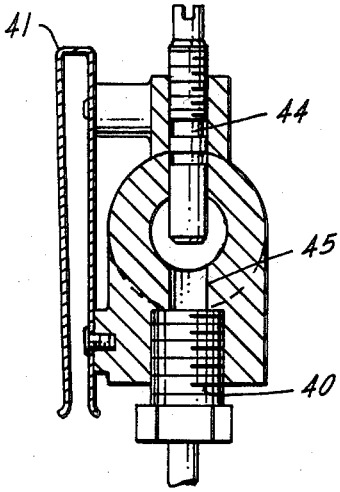
FIG. 10 is a sectional view taken along the line 10—10 in FIG. 9.
Figure 9:
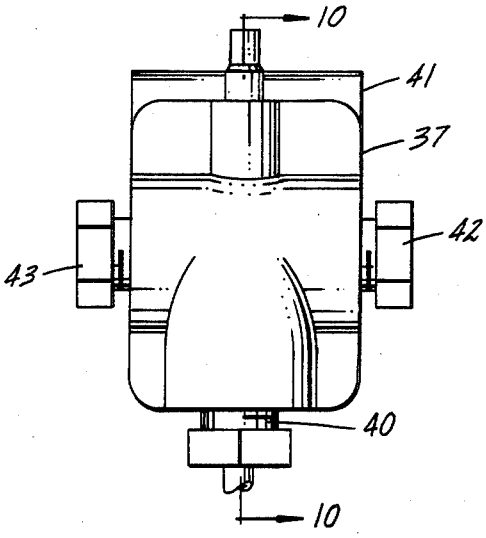
FIG. 9 is a fragmentary elevational view of the valve assembly.

In accordance with the invention, the covers 26 having openings which are normally employed to retain the particulate filter 29 and the particulate filters are both eliminated and an imperforate cap 30 is snapped over each vapor filter. As shown in FIGS. 5 and 6, cap 30 includes a base wall 31 and a peripheral wall 32. The inner surface of peripheral wall 32 of cap 30 includes a first row of circumferentially spaced ribs 33 and a second row of circumferentially spaced ribs 34, the first and second rows of ribs having different internal diameters so that the cap can be snapped into position over either of the two commercially available vapor filters 27 which have different diameters (FIGS. 7, 8).

Thus, the ribs 33 can engage the bead of a vapor filter 27 having a larger diameter and the ribs 34 can engage the bead of a vapor filter 27 having a smaller diameter.

A radial opening 35 is provided and extends from the peripheral wall through a protrusion extending from the peripheral wall 32 of each cap into each cap. As shown, each tube 36 extends from each cap 30 to one stem of a J connector and then through another stem to a tube 39 which extends to a first outlet 40 of a valve 37. The valve 37 is provided with a hook 41 for attachment to the belt or clothing of the wearer. The valve 37 further includes an inlet 42 for connection to a source of air, a second outlet 43 for connection to a spray gun and a threaded metering valve stem or member 44 positioned through a bore in the valve for varying the amount of air passing to the face mask.

When the stem 44 extends into opening 45, a clearance is provided between opening 45 and stem 44 so that a minimum amount of air will always flow to the mask even when the metering valve member is fully extended into the passage.

It can thus be seen that there has been provided a simple and inexpensive means of attachment to a conventional safety mask for providing air from a remote source. The provision of the valve body on the wearer performs the dual function of attaching the hose from the air source, providing the air to the mask, and providing air to the gun.

We claim:

1. In a safety mask comprising a mask body adapted to be placed over the nose and mouth and having means for holding the mask body over the nose and mouth wherein the mask body has an inlet valve, first threaded receptacle means associated with and overlying said inlet valve, a vapor solvent filter having an outlet and an inlet and threads at the outlet, said first receptacle means for threadedly receiving the vapor solvent filter therein and for providing fluid communication between said outlet and said inlet valve, said vapor filter having an annular bead on the periphery thereof surrounding the inlet, the improvement comprising an imperforate cap telescoped over the inlet of said vapor filter and snapped onto the annular bead of said vapor filter, said cap including a base wall and a peripheral wall extending from said base wall, means interengaging the cap and filter and providing a seal between the cap and filter including a row of circumferentially extending ribs on the inner surface of the peripheral wall of said cap which engage said bead on the periphery of the vapor filter, said peripheral wall having a radial opening therethrough, a valve adapted to be attached to the belt or clothing of the wearer, said valve having an inlet adapted to be connected to a source of air and a first outlet and a second outlet fluidically communicating with said inlet with means for connection to a paint spray gun, said mask further including a second inlet valve, second threaded receptacle means associated with and overlying said second inlet valve, a second vapor filter having an outlet and an inlet and threads at the outlet, said second receptacle means for threadedly receiving the second vapor solvent filter therein and for providing fluid comunication between the outlet of said second vapor filter and said second inlet valve, said second vapor filter having annular bead on the periphery thereof surrounding the inlet of said second vapor filter, a second imperforate cap telescoped over the inlet of said second vapor filter and snapped onto the annular bead of said second vapor filter, said cap including a base wall and a peripheral wall extending from said base wall, a radial opening through the peripheral wall, means interengaging said second cap and said second filter and providing a seal between said second cap and said second filter including a row of circumferentially extending ribs on the inner surface of the peripheral wall which engage the bead on the second filter, and means for fluidically interconnecting the radial opening of said second cap to said valve and said radial opening of said first cap comprising a T connection having three openings, tubes connecting each of two openings to the radial openings of said first and second imperforate caps, an air line connecting the first outlet of the valve with the third opening of the T connection, and said valve including means for varying the amount of air passing from the inlet through said first outlet to the mask.

2. The combination set forth in claim 1 including a second row of circumferentially spaced ribs on the inner surface of said peripheral wall of each said cap between said first row and said base wall having a smaller internal diameter than said first row of ribs that each said cap may be adapted to a mask having a vapor filter of smaller diameter than the first mentioned filter which includes a bead.

3. The combination set forth in claim 1 wherein said valve includes means for defining a clearance such that a continuous minimal flow of air is provided to the mask in all positions of said means for varying the amount of the air.

4. The combination set forth in claim 1 wherein said valve further comprises wherein said means for varying the amount of air comprises an axially adjustable metering valve stem means positioned in said valve and extending axially into said first outlet for varying the amount of air passing to the mask, said means for defining a clearance comprising said stem and said one outlet sized to provide a clearance therebetween in all positions of said stem so that there is a continuous minimal flow of air to the mask.

* * * * *